US006799392B2

(12) United States Patent
Milec et al.

(10) Patent No.: US 6,799,392 B2
(45) Date of Patent: Oct. 5, 2004

(54) SAFETY LOCK AGAINST AN UNDESIRED PULLING OF A SHORT FIREARM OUT OF ITS SCABBARD

(76) Inventors: Jiří Milec, Pod šachtami 303, 261 00 Příbram IV (CZ); Vratislav Žák, Trešňová608, 549 01 Nové Město nad Metují (CZ)

( * ) Notice: Subject to any disclaimer, the term of this patent is extended or adjusted under 35 U.S.C. 154(b) by 29 days.

(21) Appl. No.: 10/276,260

(22) PCT Filed: May 17, 2001

(86) PCT No.: PCT/CZ01/00029

§ 371 (c)(1),
(2), (4) Date: Feb. 6, 2003

(87) PCT Pub. No.: WO01/88459

PCT Pub. Date: Nov. 22, 2001

(65) Prior Publication Data

US 2003/0126783 A1 Jul. 10, 2003

(30) Foreign Application Priority Data

May 17, 2000 (CZ) ..... 2000-10778

(51) Int. Cl.[7] ..... F41A 17/00; F41C 33/02

(52) U.S. Cl. ..... 42/70.07; 42/70.01; 42/70.11; 224/244; 224/245

(58) Field of Search ..... 224/244, 3, 2, 224/245; 42/70.01, 70.07, 70.11

(56) References Cited

U.S. PATENT DOCUMENTS

| | | | | | |
|---|---|---|---|---|---|
| 1,635,984 | A | | 7/1927 | Corriston | |
| 1,641,439 | A | | 9/1927 | Jovino | |
| 2,551,913 | A | | 5/1951 | Toby | 224/2 |
| 3,550,822 | A | * | 12/1970 | Lloyd | 224/193 |
| 3,828,990 | A | * | 8/1974 | Baldocchi | 224/193 |
| 4,225,067 | A | | 9/1980 | Bianchi et al. | |
| 4,256,243 | A | * | 3/1981 | Bianchi et al. | 224/244 |
| 4,392,318 | A | * | 7/1983 | Daniels | 42/70.11 |
| 5,012,605 | A | * | 5/1991 | Nishioka | 42/70.07 |
| 5,048,735 | A | | 9/1991 | McCormick | 224/244 |
| 5,054,222 | A | * | 10/1991 | Hardy | 42/70.07 |
| 5,620,017 | A | | 4/1997 | Yamada | |
| 5,768,819 | A | * | 6/1998 | Neal | 42/96 |
| 5,810,221 | A | | 9/1998 | Beletsky et al. | |
| 5,918,784 | A | | 7/1999 | Serpa | 224/244 |
| 6,142,313 | A | * | 11/2000 | Young | 211/4 |
| 6,533,149 | B2 | * | 3/2003 | Vor Keller et al. | 224/244 |
| 2003/0042279 | A1 | * | 3/2003 | Locklear | 224/244 |

OTHER PUBLICATIONS

International Search Report, Oct. 23, 2001.

* cited by examiner

*Primary Examiner*—Michael J. Carone
*Assistant Examiner*—L. Semunegus
(74) *Attorney, Agent, or Firm*—Burns, Doane, Swecker & Mathis, L.L.P.

(57) ABSTRACT

A safety lock against an undesired pulling of a short firearm out from its scabbard consists of a flat element with components for its attachment to a side of the scabbard on the user's side, and an active element in the form of a double-arm lever, one end of which is arranged to be located in a bow of a short firearm to be placed in the scabbard and an action release end located close to the user's thumb, while the axis around which the double-arm lever of the active element turns, is attached to the flat element, and a spring element for keeping the active element in its working position is attached to the active element.

3 Claims, 1 Drawing Sheet

SAFETY LOCK AGAINST AN UNDESIRED PULLING OF A SHORT FIREARM OUT OF ITS SCABBARD

FIELD OF THE INVENTION

The present invention relates to a safety lock against an undesired pulling of a short firearm out of its scabbard, especially a service scabbard.

BACKGROUND OF THE INVENTION

A necessary accessory of a short firearm is its scabbard. These scabbards are produced of different materials, like leather, synthetic material, plastic, their combination and so on. Scabbards are primarily designed for carrying mostly on the hip or in the armpit of the user. Although the scabbards primarily serve for carrying of the weapons, they also have to comply with other requirements, like the easy and fast pulling out of the firearm, and the location of the weapon in such a way that no spontaneous shot or damage of the firearm could occur.

Especially in the case of service scabbards, it is necessary to be able to pull the firearm out very quickly, without the danger that the weapon gets stuck in its scabbard. For the above-mentioned reasons, service scabbards intended for carrying in public by members of security bodies must be open. Owing to this fact, it can happen that in case of physical contact with the attacker, the weapon gets to the attacker's hands. To avoid these cases, the scabbards are most often furnished with safety straps. A press button, Velcro, pin and hole, etc, fastens these straps. To avoid their undesired release, they have various shapes, are combined in different ways, etc. In addition to the fact that the above-mentioned solutions cannot entirely prevent an undesired pulling of the short firearm out of its scabbard, they also influence slower removal of the weapon by its owner.

SUMMARY OF THE INVENTION

The above-mentioned drawbacks are to a great extent eliminated by the safety lock against an undesired pulling of a short firearm out of its scabbard, pursuant to this technical solution. Its substance is the fact that it consists of a flat element with components for its attachment to the side of the scabbard on the user's side. The safety lock also consists of an active element in the form of a double-arm lever, one end of which is, in case the short firearm is placed in its scabbard, placed in its bow, and the other action release end is located close to the user's thumb. The axis, around which the double-arm lever of the active element turns, is attached to the flat element. A spring element for keeping the active element in the working position is also connected to the active element.

The components of the element for its connection to the side of the scabbard on the user's side conveniently consists of holes for screws going through the sides of the scabbard. The spring element is conveniently formed of a spring located on the axis.

The safety lock pursuant to this technical solution prevents an undesired pulling of the short firearm from its scabbard. The butt-end of the weapon is freely accessible for its grip, and it is not necessary to loosen safety straps. The flat element can be provided in most of the existing scabbards for short firearms, while the space for the firearm is not substantially reduced, nor is it harder to pull the gun out. Thanks to its components, the element can be easily attached to the side of the scabbard on the user's side. The active element in the form of a double-arm lever secures the short firearm in its scabbard by one of its ends. This securing is realized by placing one end of the double-arm lever in the bow of the firearm. The other action release end is located close to the user's thumb between the user's body and the firearm. This provides an easy pulling of the weapon after pressing the long action release end, and at the same time, pressing by an unauthorized person is more complicated due to the location of the respective end. With regard to the fact that the axis, around which the double-arm lever of the active element turns, is attached to the flat element, this axis is protected against damage and at the same time, it provides exact guidance for the active element. For securing of the active element in the working position, the element is furnished with a spring element. The holes for screws, which go through the sides of the scabbard, allow an easy installation of the element into various scabbards. The spring element, consisting of a spring on the axis, has a long service life and takes up only a minimum of space.

The safety lock pursuant to this solution can be provided in various existing scabbards. The safety lock increases the safety of carrying weapons, primarily the service ones. With regard to the fact that it is not necessary to use safety straps, it is possible to achieve a higher speed in pulling the weapon out of its scabbard. Also in view of the fact that it is possible to remove the safety straps, the weight of the scabbard is not increased. The safety lock can be produced of various materials, especially plastic. In this case, repeatable production with low production costs is secured.

BRIEF DESCRIPTION OF THE DRAWINGS

The technical solution will be described on a specific example of the safety lock against an undesired pulling of a short firearm out of its scabbard, and using the enclosed drawings, where.

DETAILED DESCRIPTION OF THE PREFERRED EMBODIMENTS

Figure 1:
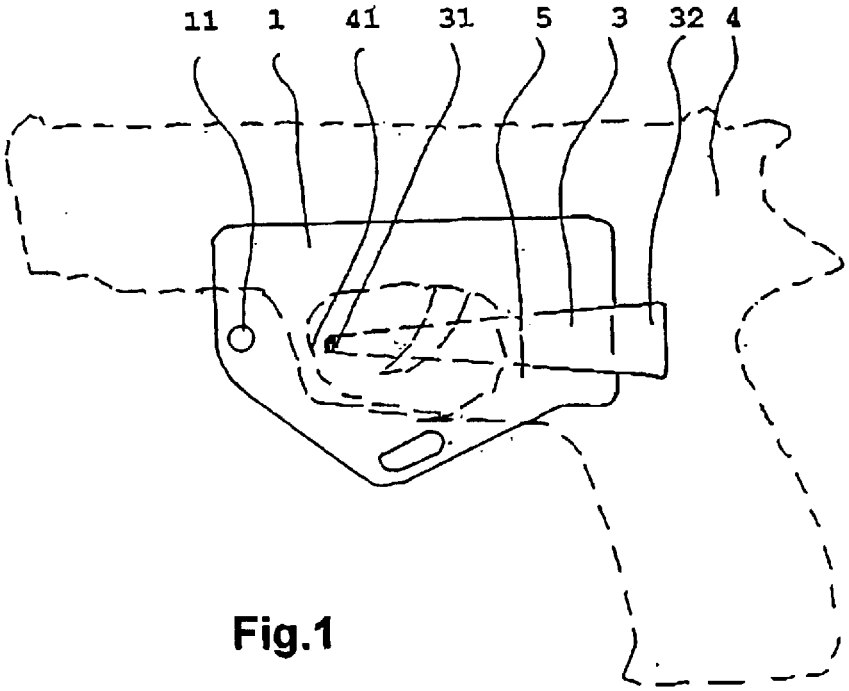
FIG. 1 shows the sample safety lock in a front view.
Figure 2:
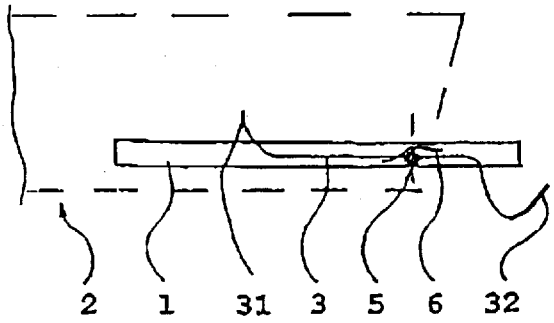
FIG. 2 shows it in a ground plan.

The sample safety lock against an undesired pulling of a short firearm out of its scabbard consists of a flat element 1 with components 11 in the form of holes for screws, which go through the sides of the scabbard 2, for its attachment to the side of the scabbard 2 on the user's side. The safety lock can be provided in different types of existing scabbards. The safety lock also consists of an active element 3 in the form of a double-arm lever. One of its ends 31 is located in the bow 41 of the weapon, if the short firearm 4 is placed in the scabbard 2. The other action release end 32 is located close to the user's thumb. The axis 5, around which the double-arm lever of the active element 3 turns, is attached to the flat element 1. A spring element 6 consisting of a spring for keeping the active element 3 in its working position is also attached to the active element 3.

If the short firearm is placed in the scabbard 2, one end 31 of the double-arm lever of the active element 3 slips into the bow 41, thanks to the spring element 6. Thus the weapon is secured against undesired removal. In case it is necessary to pull the firearm out, the user pushes the second action release end 32 of the active element 3 by his thumb, resulting in release of the bow, and the weapon can be easily pulled out. With regard to the fact that the second action release end 32 is located close to the user's thumb, between the user's body and the firearm, the weapon can be pulled out quite quickly, and at the same time it is difficult for an unauthorized person to pull the firearm out.

Industrial Applications

The safety lock against an undesired pulling of a short scabbard can be used especially for service scabbards.

We claim:

1. A safety lock against an undesired pulling of a short firearm out from its scabbard, characterized by the fact that it consists of a flat element with components for its attachment to a side of the scabbard on a user's side, and an active element in the form of a double-arm lever, one end arranged to be in a bow of a short firearm to be placed in the scabbard, and an action release end of the active element located to be close to the user's thumb, while the axis around which the double-arm lever of the active element turns, is attached to the flat element, and a spring element for keeping the active element in its working position is attached to the active element.

2. The safety lock according to claim 1, characterized by the fact that the components of the flat element for its attachment to the side of the scabbard on the user's side consist of holes for screws going through the sides of the scabbard.

3. The safety lock according to claim 1, characterized by the fact that the spring element consists of a spring located on the axis of the double-arm lever of the active element.

* * * * *